US005403180A

United States Patent [19]

Chato

[11] Patent Number: 5,403,180

[45] Date of Patent: * Apr. 4, 1995

[54] PULSATING COMBUSTORS

[76] Inventor: John D. Chato, 1412-1450 Chestnut Street, Vancouver, British Columbia, Canada, V6J 3K3

[ * ] Notice: The portion of the term of this patent subsequent to Sep. 7, 2010 has been disclaimed.

[21] Appl. No.: 115,635

[22] Filed: Sep. 3, 1993

Related U.S. Application Data

[63] Continuation of Ser. No. 829,058, Feb. 7, 1992, Pat. No. 5,242,294.

[30] Foreign Application Priority Data

Jun. 13, 1990 [GB] United Kingdom ..... 9013154

[51] Int. Cl.[6] ..... F23C 11/04

[52] U.S. Cl. ..... 431/1; 122/24; 126/350 R; 126/360 R

[58] Field of Search ..... 431/1; 122/24; 126/360 R, 350 R, 99 R, 116 R

[56] References Cited

U.S. PATENT DOCUMENTS

| | | | |
|---|---|---|---|
| 2,635,420 | 4/1953 | Jonker . | |
| 3,169,570 | 2/1965 | Haag et al. | 431/1 |
| 3,183,895 | 5/1965 | Haag | 431/1 |
| 4,479,484 | 10/1984 | Davis | 431/1 |
| 4,569,310 | 2/1986 | Davis . | |
| 4,639,208 | 2/1987 | Inui et al. . | |
| 4,759,312 | 7/1988 | Pletzer | 431/1 |
| 4,846,149 | 7/1989 | Chato . | |
| 5,044,930 | 9/1991 | Hongo | 431/1 |
| 5,242,294 | 9/1993 | Chato | 431/1 |

FOREIGN PATENT DOCUMENTS

| | | | |
|---|---|---|---|
| 1050881 | 1/1954 | France . | |
| 200910 | 11/1983 | Japan | 431/1 |
| 877227 | 11/1981 | U.S.S.R. | 431/1 |
| 9119941 | 12/1991 | WIPO . | |

*Primary Examiner*—James C. Yeung
*Attorney, Agent, or Firm*—Shoemaker and Mattare, Ltd.

[57] ABSTRACT

A pulsating combustor includes a combustion chamber having a hollow cylindrical form and a tailpipe having a similar hollow cylindrical form, such that the internal chambers are annular in section. Air and fuel are admitted to the combustion chamber and pulsating combustion is initiated, with exhaust gases being removed from the tailpipe. A water jacket is defined both inside and outside the pulsating combustor, with water being moved from one to the other as it is being warmed. Fuel is preferably admitted along needles or short pipes which are such as to have a natural resonant frequency which is a small number multiple of the natural resonant frequency of the combination of the combustion chamber and the tailpipe. Preferred frequencies are 440 cps for the combination combustion chamber and tailpipe, and 1320 cps for the fuel delivery needle or pipe.

12 Claims, 3 Drawing Sheets

PULSATING COMBUSTORS

This is a continuation of application Ser. No. 07/829,058, filed Feb. 7, 1992, now U.S. Pat. No. 5,242,294.

This invention relates generally to an improved design for a pulsating combustor, and its method of operation. More particularly, this invention is directed to a pulsating combustor design which can be used as the heat source in a highly efficient water heater or boiler.

PRIOR ART

A significant prior patent is my own U.S. Pat. No. 4,846,149, issued Nov. 7, 1989, and entitled "Fluid Heater Using Pulsating Combustion".

While the design in the U.S. Pat. No. 4,846,149 is capable of a high rate of heat transfer through the walls to a cooling medium such as water, the shape of the item in the issued U.S. patent is not conducive to compactness of size for a water heater.

Other attempts to utilize a pulsating combustor to heat water have encountered problems in muffling the sound of the unit. More particularly, the prior art combustors have generally taken the shape of a "bottle" with an elongated neck portion (the tailpipe), and with combustion taking part in the main portion of the "bottle". Unfortunately, it is found with this prior art design that the tailpipe has to be overly long in order to provide a sufficiently large heat transfer surface. With a long tailpipe, however, the frequency of the pulsating combustion is generally in the low range, typically around 50 cps. A low-pitched noise of this kind is very difficult to damp out, and as a result water heaters or boilers which utilize this pulsating combustor design tend to be very noisy.

Finally, there is a need for a pulsating combustor design in which the combustion is particularly stable, and not easily destroyed by the imposition of clashing frequencies from the outside.

GENERAL DESCRIPTION OF THIS INVENTION

It is an object of one aspect of this invention to provide a pulsating combustor in which the stability of the pulsation is improved.

It is an object of a further aspect of this invention to provide a pulsating combustor capable of use as a water boiler or heater and which operates on a relatively high frequency that is easily muffled.

It is an object of a final aspect of this invention to provide a compact design for a water heater or boiler which produces high rates of heat transfer to the water.

Accordingly, this invention provides a pulsating combustor, comprising:

an elongate combustion chamber having a first pair of walls spaced uniformly apart and an end wall bridging said first pair of walls;

an elongate tailpipe portion having a second pair of walls spaced uniformly apart, the distance separating said second pair of walls being smaller than the distance separating said first pair of walls;

a bridging portion connecting the combustion chamber with the tailpipe portion and being defined by bridging walls that are convergent when viewed in axial section;

fuel intake pipe means for introducing fuel into said combustion chamber;

air intake means for introducing combustion air into said combustion chamber;

ignition means for initiating combustion within the combustion chamber; and means ensuring that said elongate combustion chamber, elongate tailpipe portion and bridging portion together form a unit which is entirely closed to the exterior but for an elongate slot at the end of the elongate tailpipe portion remote from said end wall and for openings for said intake means and ignition means, the improvement wherein each of said fuel intake means and the combustion of said combustion chamber and said tailpipe portion has a characteristic resonant frequency depending on its dimensional characteristics, the resonant frequency of the fuel intake means and the resonant frequency of the combination of said combustion chamber and said tailpipe portion being related to each other as the ratio between two whole numbers less than 6.

GENERAL DESCRIPTION OF THIS INVENTION

Several embodiments of this invention are illustrated in the accompanying drawings, in which like numerals denote like parts throughout the several views, and in which:

FIG. 1 is a schematic sectional view through a pulsating combustor similar to that described in my U.S. Pat. No. 4,846,149, useful for understanding the present improvement;

DESIGNING FOR RESONANT FREQUENCIES

Figure 5:
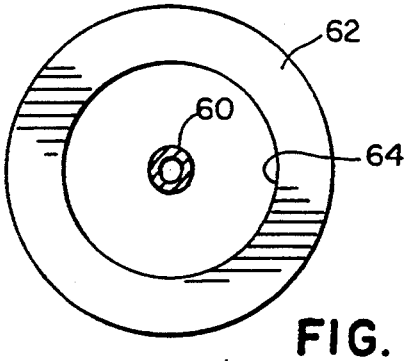
FIG. 5 is a view looking in the direction of the arrows 5—5 in FIG. 4.

This first aspect of the present invention relates to a method of optimizing the performance of a pulsating combustor.

Pulsating combustion has been studied since the early part of the century, and many different types of linear pulse burners, incorporating both flap valve and aerodynamic types of fuel inlets, have been constructed.

Studies I have carried out relating to the pulsating blade combustor that is set forth in my U.S. Pat. No. 4,846,149 identified above, have shown that it is advantageous to achieve a resonance match between the fuel intake pipe, and the combustor itself. Generally, the concept of resonance refers to a condition in which a vibrating system responds with maximum amplitude to an alternating driving force. This condition exits when the frequency of the driving force coincides with the natural undamped oscillatory frequency of the system.

Thus, a pulse burner, operating in the resonating mode, provides the greatest potential for:

(a) a maximum amplitude pressure wave;

(b) maximum heat flux potential;

(c) maximum potential for complete combustion.

Resonance matching has shown itself to be particularly advantageous in the utilization of higher frequencies, about which a brief discussion is appropriate.

As mentioned above, an advantage of higher frequencies in commercial pulse combustors lies in the ability to control the burner noise due to the shorter sound wavelength. This means that a smaller resonant cavity is necessary in the exhaust duct to control the inherent operating sound of the combustor. An additional advantage arises in the suppression of NOx which is also due to the shorter pulse duration that interferes with the kinetics of NOx formation. Until recently, however, tubular high frequency devices (>350 Hz) were a laboratory curiosity only, and were not commercially viable due to their inherent low capacity. High efficiency pulsating combustors are presently on the market but are characterized by a low operating frequency of around 50 Hz. This is necessary in a tubular unit so that the capacity and surface area for heat transfer is large enough to provide a practical size of domestic burner.

The pulse blade combustor which is set forth in my above-identified U.S. Pat. No. 4,846,149 operates in the same linear mode as a tube pulse burner, but burns on a flat rather than a circular flame front. The novelty of that approach is apparent in view of the fact that it was hitherto believed by researchers in the field that the viscous drag over a vastly increased heat transfer area would inhibit the combustion. This was found not to be the case, and I was able to successfully construct an operating pulse blade combustor incorporating aerodynamic valving of natural gas, the unit having a width of approximately 12" and a length of approximately 14". The operating frequency was 441 Hz and the gas consumption was nominally 100,000 BTU/Hr. This unit is adapted for incorporation into a water heater which, with some residual heat reclaimed from the exhaust gases, acts with a percentage efficiency in the high 90's.

Turning now to the question of resonance-matching, a typical resonant frequency ratio for a high-frequency, high efficiency blade combustor would be the following:

the fuel intake pipe resonance frequency is 1320 Hz;

the combination combustion chamber and tailpipe resonant frequency is 440 Hz.

It will be noted that the resonant frequency of the fuel intake pipe is a multiple of three times that of the combination of the combustion chamber and the tailpipe. This means that the resonant frequency of the intake pipe represents the third harmonic of what may be considered a basic frequency of 440 Hz. Musically, these frequencies represent the note A (440) below middle C, and the not E(1320) which is an octave and a fifth above the A. I have specifically found that when the fuel intake pipe resonant frequency is the third harmonic of the basic frequency of the combustion chamber and tailpipe, an extremely stable pulsating combustion is established. Whereas the pulsating combustion in many conventional combustors can be hindered or totally repressed by superimposing an externally generated sound frequency which is not a multiple of the basic frequency of the combustor, such hindrance or repression is virtually impossible when the intake pipe frequency is "turned" to the combustion chamber/tailpipe frequency in the manner described above. Therefore the procedure to achieve resonance begins by determining the base frequency of the combination combustion chamber and tailpipe. This frequency is then multiplied by 3, and then the intake tube or tubes are constructed so as to resonate at the latter frequency. This can be accomplished using a variable volume resonator.

While a third harmonic construction has been found to be particularly stable (i.e. a construction in which the fuel intake pipe resonant frequency is three times the value of the resonant frequency of the combustion chamber and tailpipe), it is considered that other simple multiples or ratios would also be useful for stabilizing the operation. Essentially, so long as the two resonant frequencies are related to each other as the ratio between two small whole numbers (typically less than six), some contribution to combustion stability will be attained. For example a ratio of 2:1 would place the higher resonant frequency one octave above the lower resonant frequency. The ratio of 4:1 would place the higher frequency two octaves above the lower frequency. In music theory, notes whose frequencies are related to one another as the ratio of small whole numbers produce a pleasing or harmonic sound.

Figure 1:
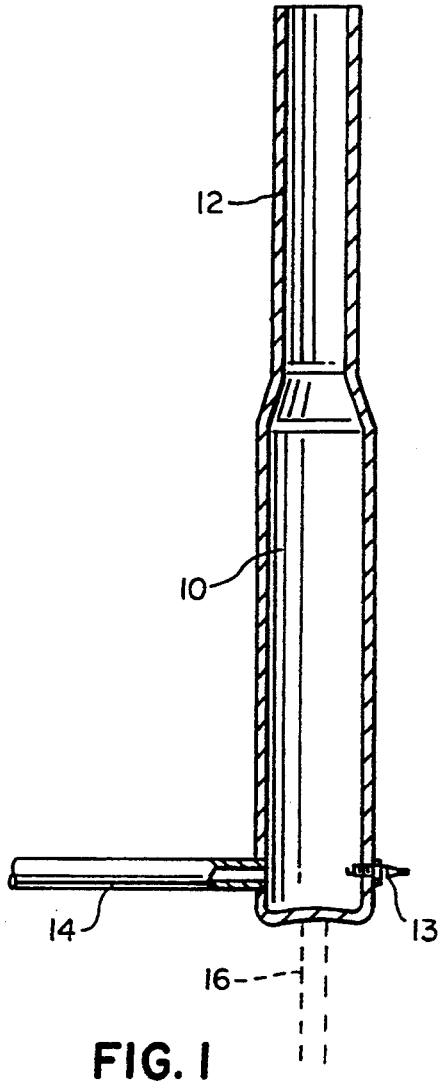
FIG. 1 (PRIOR ART)

In FIG. 1, which is a sectional view through a pulsating combustor constructed as described in my U.S. Pat. No. 4,846,149, a combustion chamber is shown at 10, a tailpipe at 12, a spark plug at 13 and fuel intake pipe at 14. It will be seen that the fuel intake pipe 14 is positioned at right angles to the main direction of the combustion chamber 10 and tailpipe 12. Another location for the fuel intake pipe is shown in broken lines at 16.

The geometry described above is expected to have application to the MHD principle, in which, assuming inductive coupling can be achieved:

(a) The tube provides a clear path for the produced EMF (eliminating eddy currents);

(b) It provides a constant volume duct as opposed to the radial, as in my first patent for MHD generators U.S. Pat. No. 4,454,436, issued Jun. 12, 1984 to Chato et al;

(c) It still maintains its narrow exhaust channel, reducing the magnetic field strength requirements and, consequently, the costs.

"HOLLOW" EMBODIMENT

Figure 2:
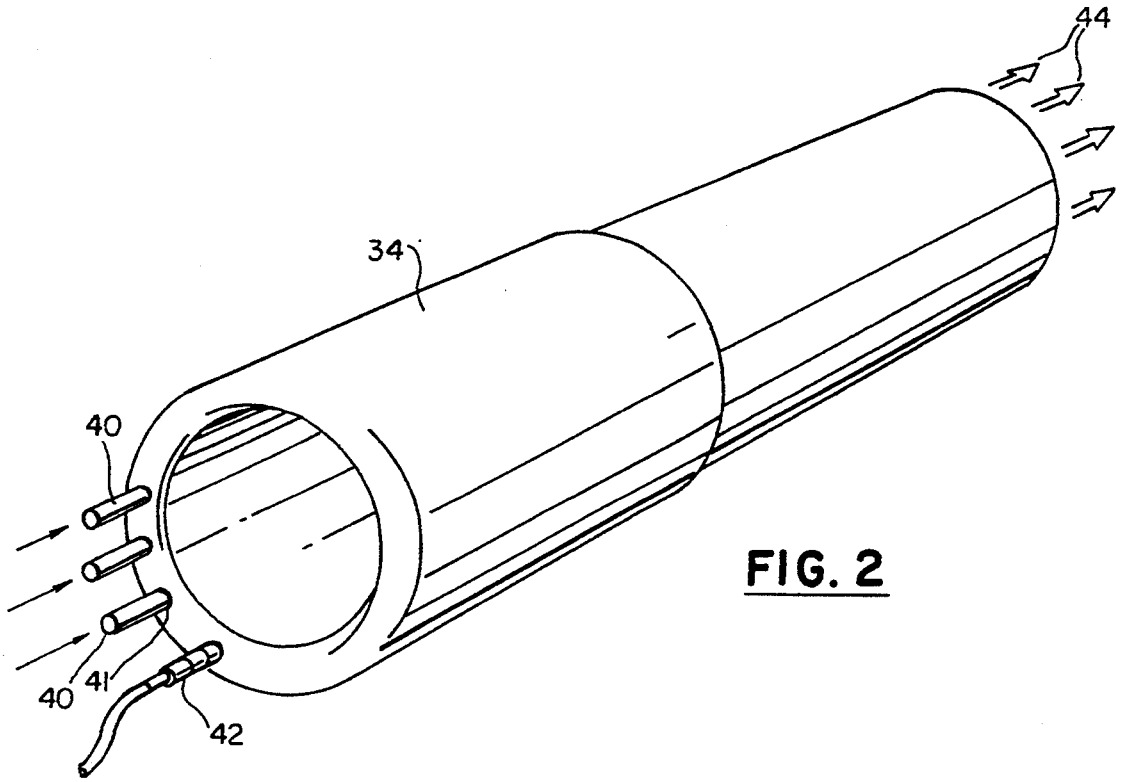
FIGS. 2 and 3 are perspective and sectional views, respectively, of a novel configuration for a pulsating chamber.
Figure 3:
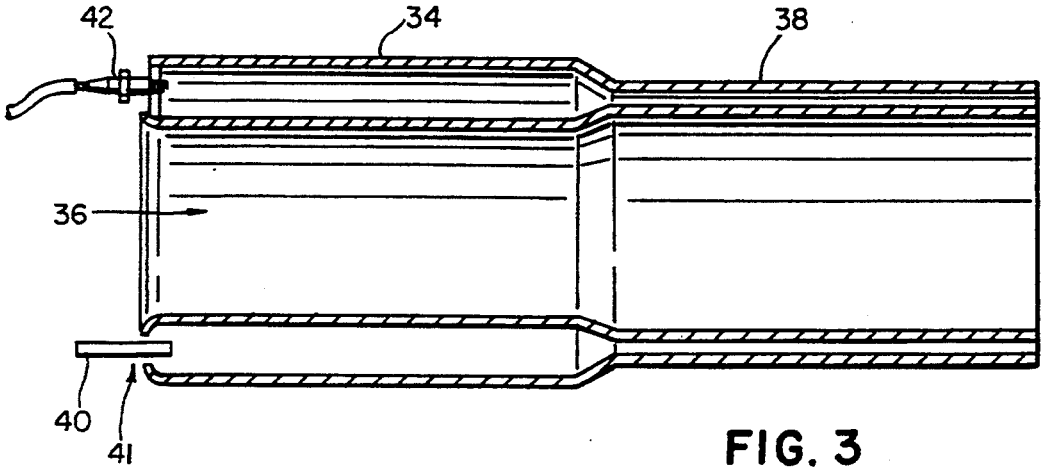

Attention is now directed to FIGS. 2 and 3, illustrating a special embodiment which is the equivalent of "curling" the flat blade embodiment of my above-identified U.S. Pat. No. 4,846,149, such that the ends of the unit adjoin one another.

Looking at FIGS. 2 and 3, a combustor 34 is in the shape of a continuous annulus with a cylindrical outer configuration, and a hollow opening 36 in the centre. The combustor 34 adjoins a similarly configured tailpipe portion 38, which is also in the shape of an annulus with a cylindrical outer configuration. As can be seen particularly in FIG. 3, the tailpipe portion 38, seen in section, is aligned axially with the combustor portion 34, and has its walls at a closer spacing than the combustor walls.

Referring to FIG. 2, there are provided a plurality of inlet needles 40, along with a sparkplug 42 for the purpose of starting the unit. It is to be understood that the needles 40 may be distributed around the entire periphery of the cylindrical configuration. In this embodiment, the needles pass through concentric air-inlet openings 41, which may also be in the form of sleeves. Alternatively, the combustion air could be provided by separate tubes or inlet means not closely associated with the fuel pins 40. The exhaust is illustrated by the arrows 44.

It is expected that the unit shown in FIGS. 2 and 3 will be capable of developing significant thrust at the arrows 44, making it suitable for use as a propulsion device.

VALVING

Figure 4:
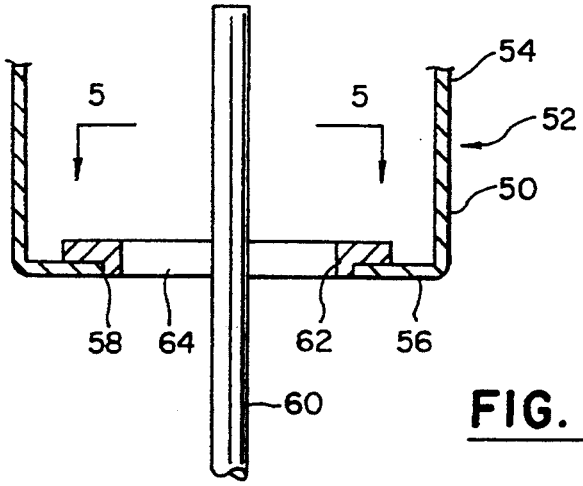
FIG. 4 is a partial sectional view through the intake region of a pulsating combustor constructed in accordance with a further novel configuration.

Attention is now directed to FIGS. 4 and 5, in connection with which a further novel aspect will now be described.

Pulse jet valving for the admission of combustion air is normally accomplished either mechanically or aerodynamically.

In the mechanical case, a valve closes against the intake opening due to the pressure created by the combustion wave. This presents a solid surface against which the wave can push, creating maximum exit velocity. A resulting sound wave whose wavelength is four times the length of the device is produced (¼ wavelength device).

In the case of the aerodynamic valve, the pressure wave encounters no such obstacle upon reaching the intake opening and so is allowed to continue its direction until reversed by the vacuum which is created behind the pressure wave as it moves toward the exhaust end. This is a situation of minimum exit velocity. The resulting sound wave has a wavelength which is two times the length of the device (½ wavelength device).

Any pulse jet system, when equipped with a heat exchanger and exhaust decoupler, loses some amount of positive thrust to the resulting back pressure. The present design is an attempt to achieve an intermediate point of operation between mechanical and aerodynamic valving to combine advantages of both systems.

Attention is directed to FIG. 4, which illustrates the air-admission end 50 of a pulsating combustor 52. The pulsating combustor includes a side wall 54 and an end wall 56, the latter having one or more circular openings 58 through which fuel and air are admitted. The fuel enters the pulsating combustor along a fuel pipe 60 which is substantially centered within the opening 58. Seated within the opening 58 is a specially designed washer 62 which functions as a stationary "valve". The internal opening 64 of the washer 62 determines the surface area available for the pressure wave to push against, i.e. the amount of positive thrust. This allows a determination of the optimum point of operation between the two valving extremes described earlier, while maintaining the advantages of aerodynamic operation.

WATER HEATER

Figure 6:
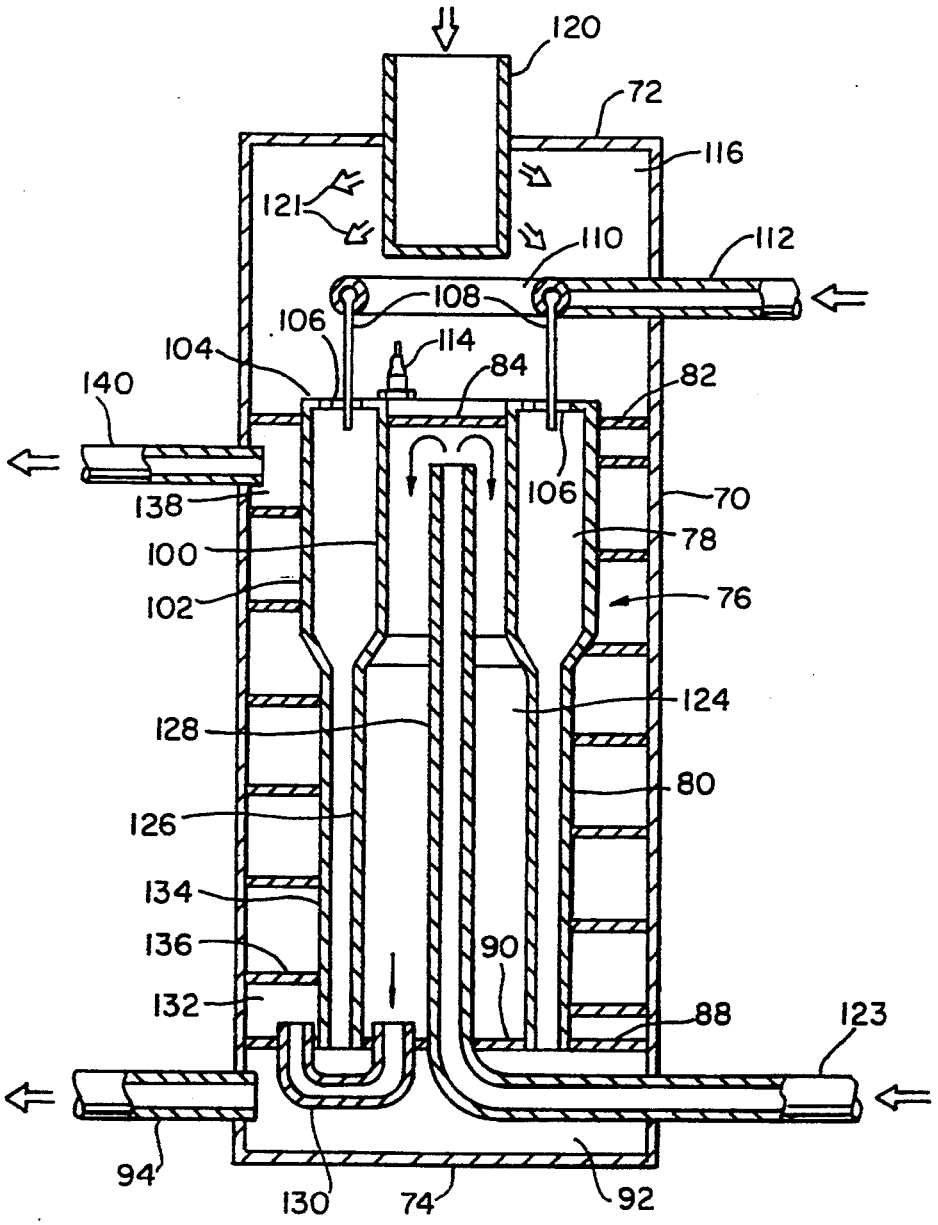
FIG. 6 is an axial sectional view through a water heater or boiler utilizing the pulsating combustor design shown in FIGS. 2 and 3.

Attention is now directed to FIG. 6, which is an axial sectional view through a suitable construction for a water boiler or heater.

In FIG. 6, an external cylindrical wall 70, with an upper end wall 72 and a lower end wall 74, supports and encloses all of the major components of the system. It will be seen that the internal components include a hollow cylindrical pulsating combustor 76 having the configuration shown in FIGS. 2 and 3, and that the pulsating combustor 76 is disposed with the combustion chamber in the upper position, and the tailpipe 80 in the lower position.

The pulsating combustor 76 is held rigidly in place by an annular partition 82 which surrounds the pulsating combustor 76 and is attached to the cylinder 70, for example by welding. A circular partition 84, coplanar with the annular partition 82, is welded or otherwise affixed to the interior space defined by the "donut" represented by the combustion chamber 78.

Toward the lower end of the unit shown in FIG. 6, a further annular portion 88 surrounds the tailpipe 80 and touches the cylinder 70, being welded or otherwise affixed to both. Also, a circular partition 90 is welded or otherwise secured inside the tailpipe 80. This allows the annular tailpipe 80 to communicate through the aligned partitions 88, 90, with an exhaust plenum 92 defined between the bottom end wall 74, the lower part of cylinder 70, and the partitions 88 and 90. An exhaust pipe 94 communicates with the plenum 92, and is adapted to lead exhaust gases away from the plenum 92.

Returning to the upper portion of the unit shown in FIG. 6, it will be seen that the combustion chamber 78 is defined between an inner, substantially cylindrical wall 100 and an outer, substantially cylindrical wall 102. An annular closure wall 104 closes the top end of the combustion chamber 78, but is provided with a plurality of circular openings 106, which may typically be 8 in number, distributed uniformly around the annular closure wall 104. Through the openings 106 pass fuel-delivery needles 108, and it can be seen that the needles project a short distance into the combustion chamber 78.

The needles are fed and supported from a fuel ring 110 which receives fuel along a fuel pipe 112 from a suitable pressurized source (not illustrated).

Figure 7:
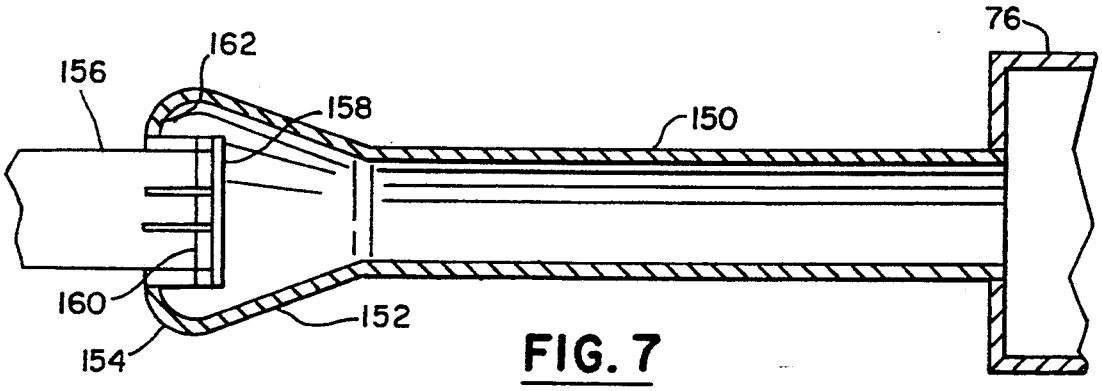
FIG. 7 shows an alternate fuel delivery construction for the unit shown in FIG. 6.

An alternative fuel delivery means is illustrated in FIG. 7, which shows the upper end of the pulse combustor 76, to which a delivery tube 150 is attached, the delivery tube 150 having a divergent upstream end 152, which undergoes an inward curvature at 154 in order to support a valve sleeve 156 that incorporates a wire frame 158 at its downstream end, the wire frame being adapted to support a valve member 160. The valve 160 rests against the frame 158 during air intake (movement to the right), but is adapted to seat against the interior lip 162 of the tube 150. The valve 150 may be either a complete disc, or an annulus with a small central opening.

A spark plug is shown at 114, to represent suitable ignition means to begin the pulsating combustion within the combustion chamber 78.

It will be seen that the top end wall 72, the upper portion of the cylinder 70, the annular partition 82 and the circular portion 84, together define a combustion air chamber 116 which is fed through a porous cup-shaped element 120, which may be of sintered metal or the like. The arrows 121 represent the admission of air from outside into the chamber 116. It will thus be understood that combustion air in the chamber 116 is available to enter the combustion chamber 78 through the plurality of openings 106.

A water-entry conduit 123, shown at bottom right in FIG. 6, passes into the plenum 92 in sealed relationship therewith, then undergoes a right-angled bend to pass through the circular partition 90, and then extends axially upwardly within the internal compartment 124 defined within the inner wall 126 of the tailpipe 80. As can be seen, water is conveyed to the top of the compartment 124 along the upright portion 128 of the conduit 123, thence undergoes a reversal of direction and flows downwardly through the compartment 124, to exit therefrom along a U-shaped conduit 130 which passes through the plenum 92 without communicating with it, and allows the partially heated water from the compartment 124 to enter the lower end of a helical passageway 132 which is defined between the outer wall 134 of the tailpipe 80, the cylinder 70, and a helical partition 136 which encircles the tailpipe 80 and the outer wall 102 of the combustion chamber. The helical passageway 132 continues around the pulsating combustor, terminating in a region 138 which is in communication with a hot water outlet pipe 140.

In operation, the unit shown in FIG. 6 is initiated by admitting fuel and combustion air to the combustion chamber 78, then starting the pulsating combustion within the chamber 78 by utilizing the spark plug 114 or other suitable means, removing exhaust gases from the tailpipe portion 80 through the plenum 92 and the exhaust pipe 94, and passing water firstly through the internal compartment 124, thence through the helical passageway 132, and finally out the water outlet pipe 140.

It will be understood that water could proceed in the opposite direction from that just detailed.

It will further be understood that the heat-transfer walls, essentially the walls 100, 102, 126 and 134, are of a material and thickness which allow good heat transfer to the water. More specifically, the walls are preferably made of a material selected from the group: copper, brass, stainless steel.

While several embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. In a pulsating combustor, comprising:

an elongate combustion chamber having a first pair of walls spaced uniformly apart and an end wall bridging said first pair of walls;

an elongate tailpipe portion having a second pair of walls spaced uniformly apart, the distance separating said second pair of walls being smaller than the distance separating said first pair of walls;

a bridging portion connecting the combustion chamber with the tailpipe portion and being defined by bridging walls that are convergent when viewed in axial section;

fuel intake pipe means for introducing fuel into said combustion chamber;

air intake means for introducing combustion air into said combustion chamber;

ignition means for initiating combustion within the combustion chamber; and said elongate combustion chamber, elongate tailpipe portion and bridging portion together forming a unit which is entirely closed to the exterior but for an elongate slot at the end of the elongate tailpipe portion remote from said end wall and for openings for said intake means and ignition means. The improvement wherein each of said fuel intake means and the combination of said combustion chamber and said tailpipe portion has a characteristic resonant frequency depending on its dimensional characteristics, the resonant frequency of the fuel intake means and the resonant frequency of the combination of said combustion chamber and said tailpipe portion being related to each other as the ratio between two whole numbers less than 6.

2. A pulsating combustor as claimed in claim 1, wherein the ratio of the resonant frequency of said fuel intake means to the resonant frequency of said combustion is 3:1.

3. A pulsating combustor as claimed in claim 1 or 2, wherein the resonant frequency of said combination is substantially 440 cycles per second.

4. A pulsating combustor as claimed in claim 1, 2 or 3, wherein the resonant frequency of the fuel intake means is substantially 1320 cycles per second.

5. A pulsating combustor as claimed in claim 1, wherein said combustor is in the form of a tube such that, when viewed in section transverse to the longitudinal axis of the tube, said combustion chamber and said tailpipe portion are annular.

6. A pulsating combustor as claimed in claim 5, further comprising water jacket means for passing water against the outside and the inside of said tube.

7. A pulsating combustor as claimed in claim 6, wherein said water jacket means passes cold water initially inside said tube in a longitudinal direction with respect to the tube and then in a helical path around the outside of said tube.

8. A pulsating combustor as claimed in claim 6 or 7, wherein all of the walls which, in use, are in contact with water are made of copper, brass or stainless steel.

9. A pulsating combustor as claimed in claim 1, wherein said combustion chamber and said tailpipe portion are axially aligned.

10. A pulsating combustor as claimed in claim 1, wherein the pulsating combustor is oriented in such that its longitudinal axis is substantially vertical and the combustion chamber is above the tailpipe portion.

11. A pulsating combustor as claimed in claim 1, wherein said fuel intake pipe means and said air intake means pass through a single opening into said elongate combustion chamber.

12. A pulsating combustor as claimed in claim 11, wherein said fuel intake pipe means and said air intake means comprise a substantially circular opening, a fuel pipe substantially centered in said circular opening and a washer having an internal opening seated within the opening.

* * * * *